US006578372B2

(12) United States Patent
Fukanuma et al.

(10) Patent No.: US 6,578,372 B2
(45) Date of Patent: Jun. 17, 2003

(54) APPARATUS AND METHOD FOR CONTROLLING VARIABLE DISPLACEMENT COMPRESSOR

(75) Inventors: Tetsuhiko Fukanuma, Kariya (JP); Hiroshi Kubo, Kariya (JP); Takuya Okuno, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 10/042,537

(22) Filed: Nov. 9, 2001

(65) Prior Publication Data

US 2002/0144512 A1 Oct. 10, 2002

(30) Foreign Application Priority Data

Nov. 10, 2000 (JP) ..... 2000-343699

(51) Int. Cl.[7] ..... F04B 1/26; F25B 1/00
(52) U.S. Cl. ..... 62/115; 62/228.3; 62/228.5
(58) Field of Search ..... 62/228.3, 228.5, 62/115; 417/222.2

(56) References Cited

U.S. PATENT DOCUMENTS 5,890,876 A 4/1999 Suito et al. ..... 417/213

FOREIGN PATENT DOCUMENTS

| | | | | |
|---|---|---|---|---|
| JP | 0077845 | * | 5/1982 | ..... 62/228.3 |
| JP | 59-112156 | | 6/1984 | ..... F25B/1/00 |
| JP | 3-986 | | 1/1991 | ..... F04B/49/00 |
| JP | 405248740 | * | 9/1993 | ..... 62/228.3 |

* cited by examiner

*Primary Examiner*—William Wayner
(74) *Attorney, Agent, or Firm*—Morgan & Finnegan, LLP

(57) ABSTRACT

A variable displacement compressor has a control valve for controlling the displacement of the compressor. When the pressure in a discharge chamber of the compressor (discharge pressure) is equal to or higher than a first threshold value, a controller sets a duty ratio, which is sent to the control valve, to zero % to limit the discharge pressure. As a result, the compressor displacement is minimized and the discharge pressure is lowered. Therefore, the pipes of an external refrigerant circuit does not receive excessive load based on high discharge pressure. When the displacement of the compressor is minimized, circulation of refrigerant in the refrigerant circuit is stopped and refrigerant containing lubricant circulates within the compressor.

17 Claims, 4 Drawing Sheets

APPARATUS AND METHOD FOR CONTROLLING VARIABLE DISPLACEMENT COMPRESSOR

BACKGROUND OF THE INVENTION

The present invention relates to a control apparatus for controlling the displacement of a variable displacement compressor used in a refrigerant circuit of a vehicle air conditioner.

A typical variable displacement compressor includes a drive plate coupled to pistons. The drive plate is accommodated in a crank chamber. The pressure of the crank chamber is adjusted to alter the inclination angle of the drive plate, which varies the displacement of the compressor between the minimum displacement and the maximum displacement. The crank chamber pressure is adjusted by a control valve. Specifically, the opening degree of the control valve is adjusted based on a command from a controller.

Clutchless type compressors, which has no clutch, such as an electromagnetic clutch, between an external drive source, such as a vehicle engine, and the drive shaft of the compressor, have been introduced. Since a clutchless type a compressor has no electromagnetic clutch, which is expensive and heavy, the cost is lowered and the weight of the compressor is reduced. Also, since there is no shock due to engaging and disengaging of an electromagnetic clutch, the engine performance is improved.

A clutchless type compressor includes means for stopping external refrigerant circulation. The stopping means stops the refrigerant circulation through an external refrigerant circuit when the displacement of the compressor is minimized. When cooling is not needed, a controller provides a control valve with a signal for minimizing the compressor displacement. Accordingly, the refrigerant circulation through the external refrigerant circuit is stopped by the stopping means and unnecessary cooling is prevented. Also, the minimum compressor displacement allows refrigerant to circulate within the compressor through the discharge chamber, the crank chamber, the suction chamber and the compression chamber, which permits the sliding parts of the compressor to be lubricated by lubricant contained in the circulated refrigerant.

If the discharge pressure is excessive in the refrigeration circuit, the pipes of the circuit receives excessive load. Therefore, when a discharge pressure sensor detects a pressure that is higher than a predetermined level, the controller adjusts the command signal to the control valve such that the compressor displacement is gradually decreased until the discharge pressure falls below the predetermined level (for example, in Japanese Unexamined Patent Publication No. 59-112156).

However, an excessively increased discharge pressure may not be quickly lowered according to a decrease in the compressor displacement. In this case, the displacement may be dropped to a value that is close to the minimum displacement. Compared to a clutch type compressor, the minimum displacement of a clutchless type compressor is significantly small so that the power loss of an engine is minimized when refrigeration is not performed. Therefore, if the displacement is close to the minimum displacement, little refrigerant is supplied to the compressor from the external refrigerant circuit. That is, lubricant contained in the refrigerant is not sufficiently supplied to the compressor. Thus, the parts needing lubrication, such as sliding portions of the pistons and the cylinder bores, will be poorly lubricated.

SUMMARY OF THE INVENTION

Accordingly, it is an objective of the present invention to provide a control apparatus and a control method that reliably lubricate the sliding parts of a variable displacement compressor when lowering an excessive discharge pressure.

To achieve the foregoing and other objectives and in accordance with the purpose of the present invention, an apparatus for controlling a variable displacement compressor used in a refrigerant circuit of an air conditioner is provided. The refrigerant circuit includes the compressor and an external circuit, which is connected to the compressor. The compressor compresses refrigerant sent from the external circuit and discharges the compressed refrigerant to the external circuit. The refrigerant circuit has a high pressure zone, which is exposed to the pressure of refrigerant that is compressed by the compressor. The compressor includes a tiltable drive plate, which is located in a crank chamber and changes its inclination angle in accordance with the pressure in the crank chamber. The inclination angle of the drive plate determines the displacement of the compressor. The apparatus includes a control valve, which adjusts the pressure in the crank chamber, and a controller for controlling the control valve. The controller sends a command value that corresponds to cooling performance required for the refrigerant circuit to the control valve. The control valve operates to adjust its opening according to the sent command value. When the pressure in the high pressure zone is equal to or higher than a predetermined threshold value, the controller sends a command value that can minimize the displacement of the compressor to the control valve thereby limiting the pressure in the high pressure zone.

Further, the present invention provides a method for controlling a variable displacement compressor used in a refrigerant circuit of an air conditioner. The refrigerant circuit includes the compressor and an external circuit, which is connected to the compressor. The compressor compresses refrigerant sent from the external circuit and discharges the compressed refrigerant to the external circuit. The refrigerant circuit has a high pressure zone, which is exposed to the pressure of refrigerant that is compressed by the compressor. The compressor includes a tiltable drive plate, which is located in a crank chamber. The drive plate changes its inclination angle in accordance with the pressure in the crank chamber. The inclination angle of the drive plate determines the displacement of the compressor. The method includes adjusting the pressure in the crank chamber by a control valve, wherein the control valve operates according to a command value, which represents cooling performance required for the refrigerant circuit, and sending a command value that can minimize the displacement of the compressor to the control valve thereby limiting the pressure in the high pressure zone when the pressure in the high pressure zone is equal to or higher than a predetermined threshold value.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A control apparatus according to a first embodiment of the present invention will now be described. The control apparatus is used in a variable displacement swash plate type compressor located in a refrigerant circuit of a vehicle air conditioner.

Figure 1:
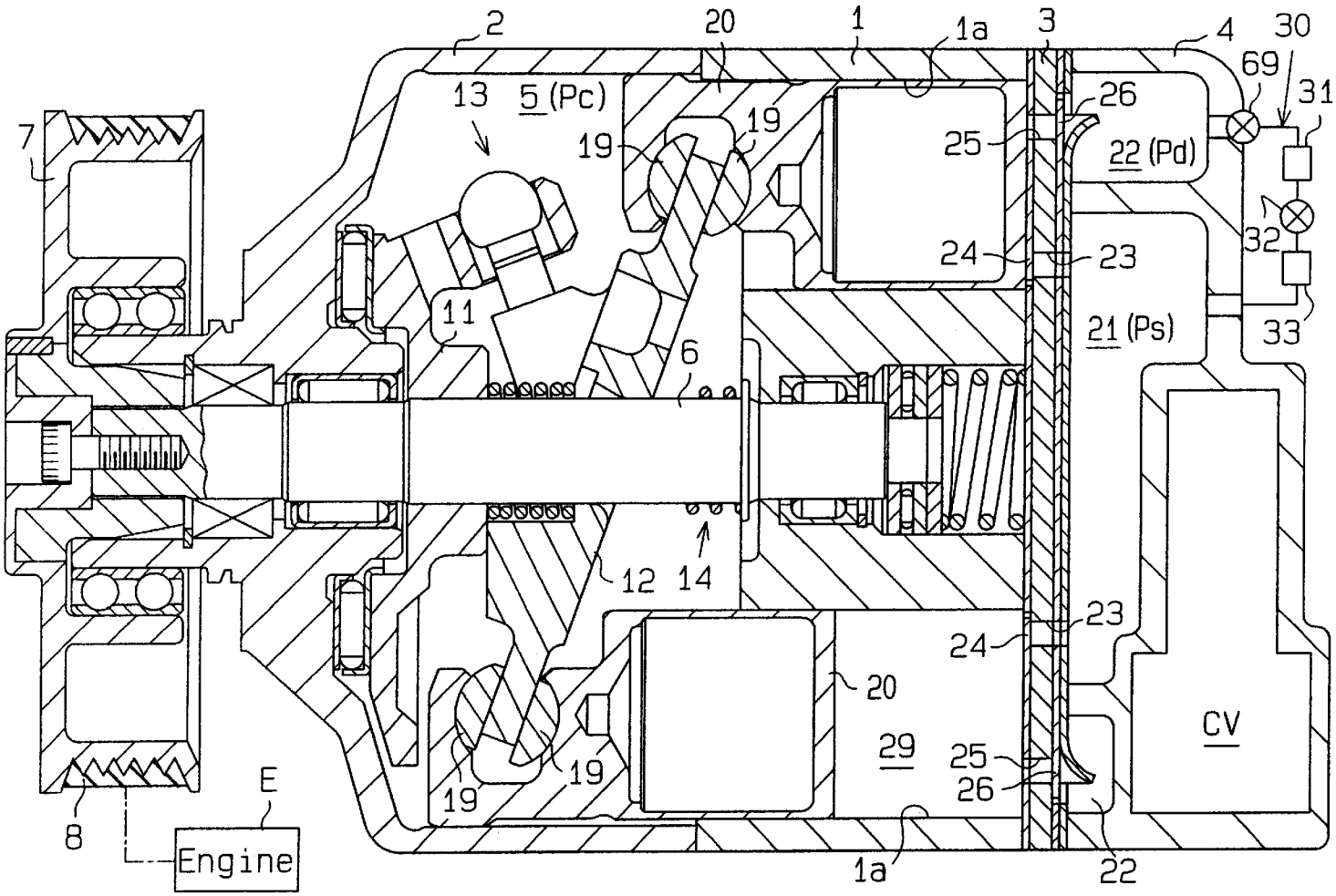
FIG. 1 is a cross-sectional view illustrating a swash plate type variable displacement compressor according to a first embodiment of the present invention.
Figure 2:
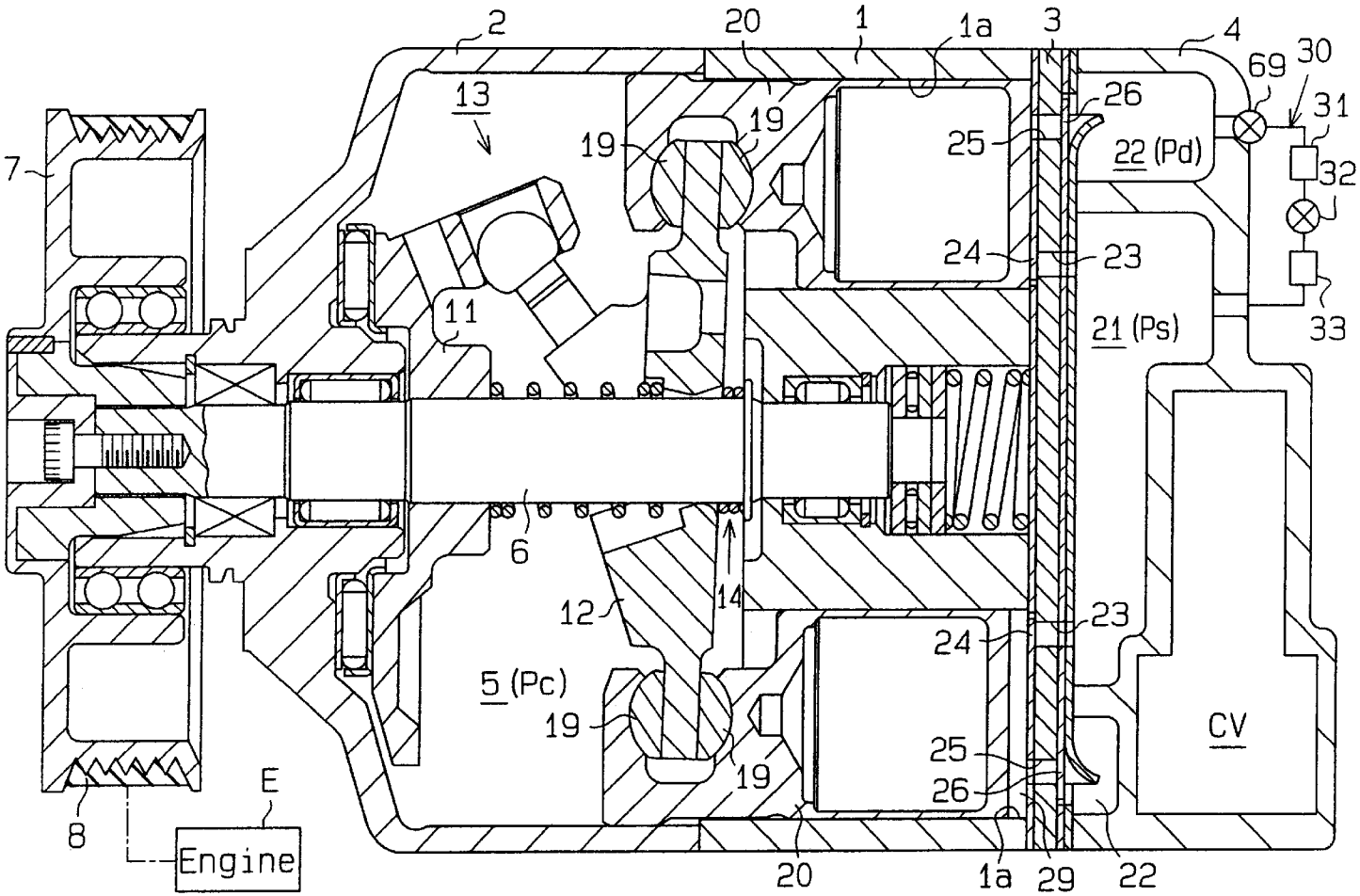
FIG. 2 is a cross-sectional view of the compressor shown in FIG. 1 when the displacement is minimum.

As shown in FIGS. 1 and 2, the compressor includes a cylinder block 1, a front housing member 2 connected to the front end of the cylinder block 1, and a rear housing member 4 connected to the rear end of the cylinder block 1. A valve plate assembly 3 is located between the rear housing member 4 and the cylinder block 1.

A crank chamber 5 is defined between the cylinder block 1 and the front housing member 2. A drive shaft 6 extends through the crank chamber 5 and is rotatably supported by the cylinder block 1 and the front housing member 2. The drive shaft 6 is connected to an external drive source, which is an engine E in this embodiment, through a power transmission mechanism without a clutch such as an electromagnetic clutch. The power transmission mechanism includes a pulley 7 and a belt 8. When the engine E is running, the drive shaft 6 is constantly rotated. Since the compressor has no electromagnetic clutch, which is expensive and heavy, the cost is lowered and the weight of the compressor is reduced. Also, since there is no shock due to engaging and disengaging of an electromagnetic clutch, the engine performance is improved.

A lug plate 11 is fixed to the drive shaft 6 in the crank chamber 5 to rotate integrally with the drive shaft 6. A drive plate, which is a swash plate 12 in this embodiment, is accommodated in the crank chamber 5. The swash plate 12 slides along the drive shaft 6 and inclines with respect to the axis of the drive shaft 6. A hinge mechanism 13 is provided between the lug plate 11 and the swash plate 12. The hinge mechanism 13 causes the lug plate 11 to rotate integrally with the drive shaft 6. The hinge mechanism 13 also permits the swash plate 12 to move along and to incline with respect to the axis of the drive shaft 6.

Cylinder bores 1*a* are formed in the cylinder block 1 at constant angular intervals around the drive shaft 6. Each cylinder bore 1*a* accommodates a single headed piston 20. A compression chamber 29, the volume of which varies in accordance with the reciprocation of the piston 20, is defined in each bore 1*a*. The front end of each piston 20 is connected to the periphery of the swash plate 12 through a pair of shoes 19. The rotation of the swash plate 12 is converted into reciprocation of the pistons 20. The lug plate 11, the swash plate 12, the hinge mechanism 13, the shoes 19 and the pistons 20 form a compression mechanism, which compresses refrigerant gas and changes the displacement of the compressor.

A suction chamber 21 and a discharge chamber 22 are defined between the valve plate assembly 3 and the rear housing member 4. The valve plate assembly 3 has suction ports 23, suction valve flaps 24, discharge ports 25 and discharge valve flaps 26. Each set of the suction port 23, the suction valve flap 24, the discharge port 25 and the discharge valve flap 26 corresponds to one of the cylinder bores 1*a*. When each piston 20 moves from the top dead center position to the bottom dead center position, refrigerant gas in the suction chamber 21 flows into the corresponding cylinder bore 1*a* via the corresponding suction port 23 and suction valve 24. When each piston 20 moves from the bottom dead center position to the top dead center position, refrigerant gas in the corresponding cylinder bore 1*a* is compressed to a predetermined pressure and is discharged to the discharge chamber 22 via the corresponding discharge port 25 and discharge valve 26.

Figure 3:
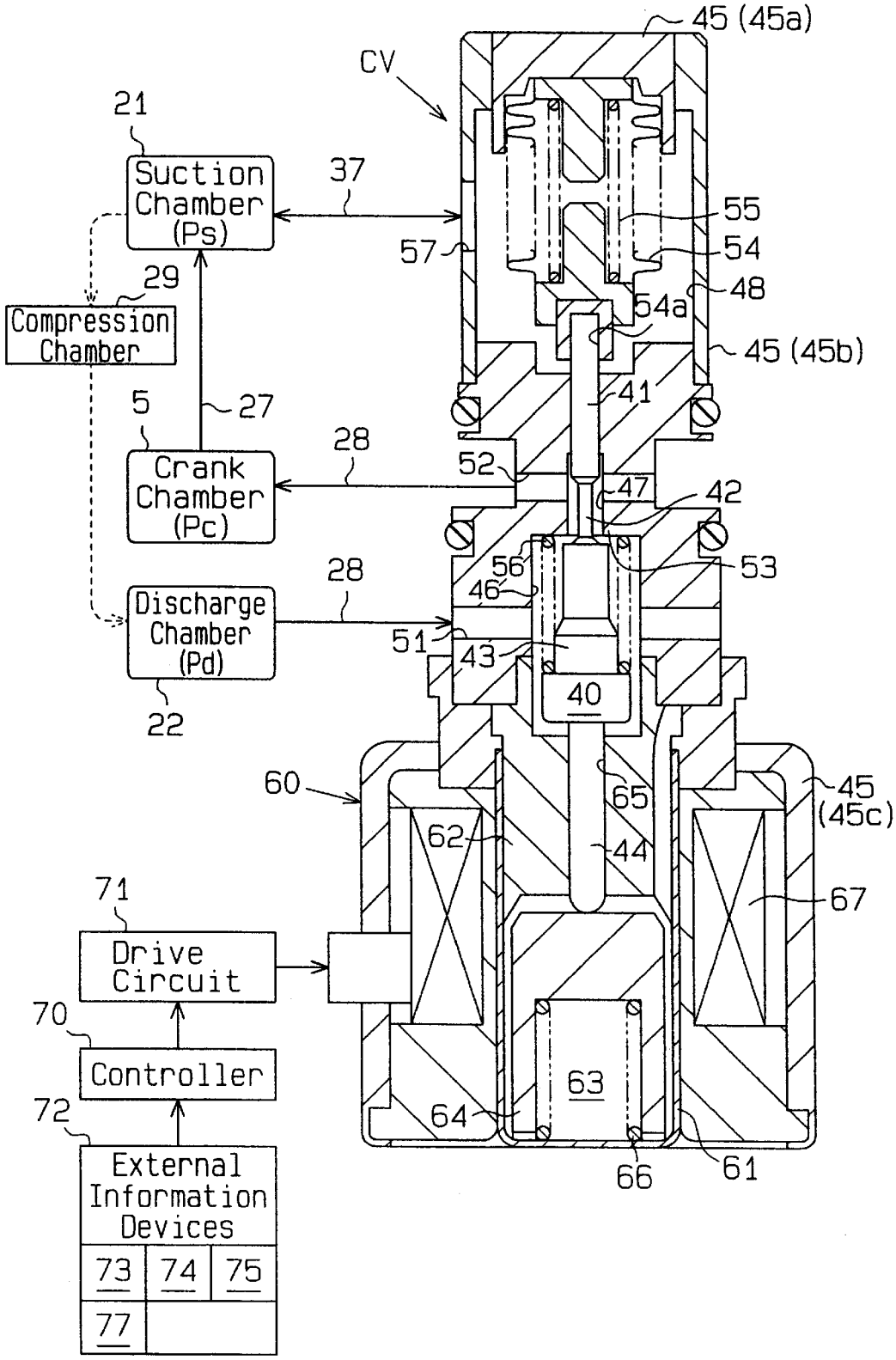
FIG. 3 is a cross-sectional view illustrating the control valve in the compressor shown in FIG. 1.

As shown in FIG. 3, a crank chamber pressure control mechanism includes a bleed passage 27, a supply passage 28, and a control valve CV. The pressure in the crank chamber 5 (crank chamber pressure Pc) affects the inclination angle of the swash plate 12. The passages 27, 28 are formed in the compressor housing, and the control valve CV is located in the compressor. The bleed passage 27 connects the crank chamber 5 with the suction chamber 21, which is exposed to suction pressure Ps. The supply passage 28 connects the discharge chamber 22, which is exposed to discharge pressure Pd, with the crank chamber 5. The control valve CV regulates the supply passage 28.

The opening of the control valve CV is adjusted to control the flow rate of highly pressurized gas supplied to the crank chamber 5 through the supply passage 28. The crank chamber pressure Pc is determined by the flow rate of the gas supplied to the crank chamber 5 through the supply passage 28 and the flow rate of refrigerant gas conducted out from the crank chamber 5 through the bleed passage 27. As the crank chamber pressure Pc varies, the difference between the crank chamber pressure Pc and the pressure in the cylinder bores 1*a* varies, which changes the inclination angle of the swash plate 12, or the angle of the swash plate 12 relative to a plane that is perpendicular to the axis of the drive shaft 6. Accordingly, the stroke of each piston 20, or the compressor displacement, is varied.

When the opening degree of the control valve CV is small, the crank chamber pressure Pc is lowered, which decreases the difference between the crank chamber pressure Pc and the pressure in the compression chamber 29. Accordingly, the inclination angle of the swash plate 12 is increased and the compressor displacement is increased. In FIG. 1, the swash plate 12 contacts the lug plate 11 and the inclination angle of the swash plate 12 is maximized. In this state, the compressor displacement is maximized.

When the opening degree of the control valve CV is increased, the crank chamber pressure Pc is increased, which increases the difference between the crank chamber pressure Pc and the pressure in the compression chamber 29. Accordingly, the inclination angle of the swash plate 12 is decreased, and the compressor displacement is decreased. In FIG. 2, the swash plate 12 contacts and compresses a spring 14 fitted about the drive shaft 6, and the inclination angle of the swash plate 12 is minimized. In this state, the compressor displacement is minimized. The minimum inclination angle of the swash plate 12 is close to zero degrees and is, for example, two to five degrees. The spring 14 functions as a means for limiting the minimum inclination angle of the swash plate 12.

As shown in FIGS. 1 and 2, the refrigerant circuit of the vehicle air conditioner includes the compressor and an external refrigerant circuit 30. The external refrigerant circuit 30 includes, for example, a condenser 31, a decompression device, which is an expansion valve 32 in this embodiment, and an evaporator 33.

A device for stopping external circulation of refrigerant, which is a shutoff valve 69 in this embodiment, is located on a refrigerant passage between the discharge chamber 22 of the compressor and the condenser 31 of the external refrigerant circuit 30. The shutoff valve 69 shuts off the refrigerant passage when the pressure Pd in the discharge chamber 22 falls below a predetermined level to stop the circulation of refrigerant through the external refrigerant circuit 30.

The shutoff valve 69 may be a differential valve, which mechanically detects the pressures at both sides. Alternatively, the shutoff valve 69 may be an electromagnetic valve, which is actuated and controlled according to the discharge pressure Pd by a controller 70, which will be discussed below. The discharge pressure Pd falls below the predetermined level when the compressor displacement is minimized. Thus, the shutoff valve 69 may be mechanically linked to the swash plate 12 such that the shutoff valve 69 shuts off the passage when the inclination angle of the swash plate 12 is minimized.

As shown in FIG. 3, the control valve CV includes a supply valve and a device for setting a target pressure, which is a solenoid 60 in this embodiment. The supply valve is arranged in an upper portion of the valve CV, while the solenoid 60 is arranged in a lower portion of the valve. The supply valve adjusts the opening size (throttle amount) of the supply passage 28, which connects the discharge chamber 22 to the crank chamber 5. The solenoid 60 is an electromagnetic actuator for urging a rod 40, which is located in the control valve CV, based on a current supplied from an outside source. The rod 40 has a distal end portion 41, a valve body 43, a connecting portion 42, which connects the distal end portion 41 and the valve body 43 with each other, and a guide 44. The valve body 43 is part of the guide 44.

A valve housing 45 of the control valve CV has a plug 45*a*, an upper half body 45*b*, and a lower half body 45*c*. The upper half body 45*b* defines the shape of the supply valve portion. The lower half body 45*c* defines the shape of the solenoid 60. A valve chamber 46 and a communication passage 47 are defined in the upper half body 45*b*. The upper half body 45*b* and the plug 45*a* define a pressure sensing chamber 48.

The rod 40 moves in the axial direction of the control valve CV, or vertically as viewed in the drawing, in the valve chamber 46 and the communication passage 47. The valve chamber 46 is selectively connected to and disconnected from the passage 47 in accordance with the position of the rod 40. The communication passage 47 is separated from the pressure sensing chamber 48 by the distal end portion 41 of the rod 40.

The bottom wall of the valve chamber 46 is formed by the upper end surface of a stationary iron core 62. A first radial port 51 is formed in a part of the wall of the valve housing 45 that surrounds the valve chamber 46. The first radial port 51 allows the valve chamber 46 to communicate with the discharge chamber 22 through an upstream section of the supply passage 28. A second radial port 52 is formed in a part of the valve housing 45 that surrounds the communication passage 47. The second radial port 52 allows the communication passage 47 to communicate with the crank chamber 5 through a downstream section of the supply passage 28. The first port 51, the valve chamber 46, the communication passage 47, and the second port 52 form a passage, which is located in the control valve CV and is a part of the supply passage 28.

The valve body 43 of the rod 40 is located in the valve chamber 46. A valve body urging spring 56 is located in the valve chamber 46 and urges the valve body 43 downward. A step is formed between the valve chamber 46 and the communication passage 47. The step functions as a valve seat 53, and the communication passage 47 functions as a valve hole. When the rod 40 is moved from the position of FIG. 3, or the lowermost position, to the uppermost position, at which the valve body 43 contacts the valve seat 53, the communication passage 47 is disconnected from the valve chamber 46. That is, the valve body 43 is a supply valve body that controls the opening size of the supply passage 28.

A pressure sensing member, which is a bellows 54 in this embodiment, is located in the pressure sensing chamber 48. The upper end of the bellows 54 is fixed to the plug 45*a* of the valve housing 45. A rod seat 54*a* is located at the lower end of the bellows 54. The upper end of the rod 40 is located in the rod seat 54*a*. An urging spring 55 is accommodated in the bellows 54 and expands the bellows 54 downward. The bellows 54 is pressed against the distal end portion 41 of the rod through the rod seat 54*a* by the downward force of the spring 55.

The pressure sensing chamber 48 is connected to a pressure monitoring point, which is the suction chamber 21, through a pressure introduction port 57 formed in the upper half body 45*b* of the valve housing 45 and a pressure introduction passage 37, which is formed in the rear housing member 4. That is, the pressure sensing chamber 48 is exposed to the pressure Ps in the suction chamber 21.

The solenoid 60 includes a cup-shaped cylinder 61. The stationary iron core 62 is fitted into an upper opening of the cylinder 61. The stationary core 62 defines a solenoid chamber 63 in the cylinder 61. A movable iron core 64 is located in the solenoid chamber 63. The movable iron core 64 is moved axially. The stationary core 62 has a guide hole 65 through which the guide 44 of the rod 40 extends.

An urging spring 66 is accommodated in the solenoid chamber 63 and urges the movable core 64 toward the stationary core 62. Therefore, the guide 44 and the movable core 64 are pressed against each other by the downward force of the spring 56 and the upward force of the spring 66 for moving core. Thus, the movable core 64 and the rod 40 move integrally.

A coil 67 is wound about the stationary core 62 and the movable core 64. The coil 67 receives drive signals from a drive circuit 71 based on command signals from the controller 70, which is a computer. Specifically, the controller 70 outputs command signals according to external information obtained from a group 72 of external information devices. The coil 67 generates an electromagnetic force that corresponds to the value of the current from the drive circuit 71. The electromagnetic force urges the movable core 64 toward the stationary core 62. The electric current supplied to the coil 67 is controlled by controlling the voltage applied to the coil 67. In this embodiment, the applied voltage is controlled by pulse-width modulation.

The group 72 of the external information devices includes, e.g., an air conditioner switch 73, a temperature adjuster 74 for setting a desired temperature in the passenger compartment, a temperature sensor 75 detecting the temperature in the passenger compartment, and a discharge pressure sensor 77 for detecting the pressure Pd in the discharge chamber 22. Based on signals from the external information device group 72, the controller 70 computes a cooling performance that is required for the refrigerant circuit and sends a command value (duty signal) that represents the required cooling performance to the coil 67 through the drive circuit 71.

The position of the rod 40 in the control valve CV, i.e., the valve opening of the control valve CV, is determined as follows.

When no current is supplied to the coil 67 (duty ratio=0%) as shown in FIG. 3, the downward force of the springs 55 and 56 is dominant in determining the position of the rod 40. As a result, the rod 40 is moved to its lowermost position and causes the valve body 43 to fully open the communication passage 47. Accordingly, the crank pressure Pc is maximized under the current circumstances. Therefore, the difference between the crank pressure Pc and the pressure in the compression chambers 29 is great, which minimizes the inclination angle of the swash plate 12 and the compressor displacement.

When refrigeration is not necessary, for example, when the air conditioner switch 73 is off, the controller 70 outputs a signal for minimizing the displacement to the control valve CV. That is, the controller 70 commands the drive circuit 71 to set the duty ratio to the coil 67 to 0%. Also, if the vehicle is abruptly accelerated when the air conditioning is operating, the controller 70 commands the drive circuit 71 to decrease the duty ratio sent to the coil 67 to 0% for reducing the driving load of the compressor, which acts on the engine E.

Thus, the compressor displacement is minimized as shown in FIG. 2. In this state, the pressure Pd at the side of the discharge chamber 22 is lower than a predetermined value, which closes the shutoff valve 69. Accordingly, the circulation of refrigerant through the external refrigerant circuit 30 is stopped. That is, when the compressor displacement is minimized, the shutoff valve 69 stops the refrigerant circulation through the external refrigerant circuit 30. Since the minimum inclination angle of the swash plate 12 is not zero, refrigerant is drawn into the compression chambers 29 from the suction chamber 21, compressed and discharged to the discharge chamber 22 even if the compressor displacement is minimized.

Accordingly, an internal refrigerant circuit, that is, a passage having the compression chambers 29, the discharge chamber 22, the supply passage 28, the crank chamber 5, the bleed passage 27, and the suction chamber 21 is formed in the compressor. Together with refrigerant, lubricant circulates in the internal refrigerant circuit. Therefore, even if refrigerant, which contains lubricant, does not return from the external refrigerant circuit 30, the sliding members (for example, the pistons 20 and the cylinder bore 1*a*) are reliably lubricated.

When the electric current corresponding to the minimum duty ratio (duty ratio>0%) within the range of duty ratios is supplied to the coil 67, the upward electromagnetic force exceeds the downward force of the springs 55, 56, and the rod 40 moves upward. In this state, the resultant of the upward electromagnetic force and the upward force of the spring 66 acts against the resultant of the forces of the springs 55, 56, which is weakened by the upward force of the bellows 54 based on the suction pressure Ps in the pressure sensing chamber 48. The position of the valve body 43 of the rod 40 relative to the valve seat 53 is determined such that upward and downward forces are balanced.

The control valve CV automatically determines the position of the rod 40 according to changes of the suction pressure Ps to maintain the suction pressure Ps to the target value. The target value of the suction pressure Ps can be externally changed by adjusting the duty ratio of the current supplied to the coil 67.

Figure 4:
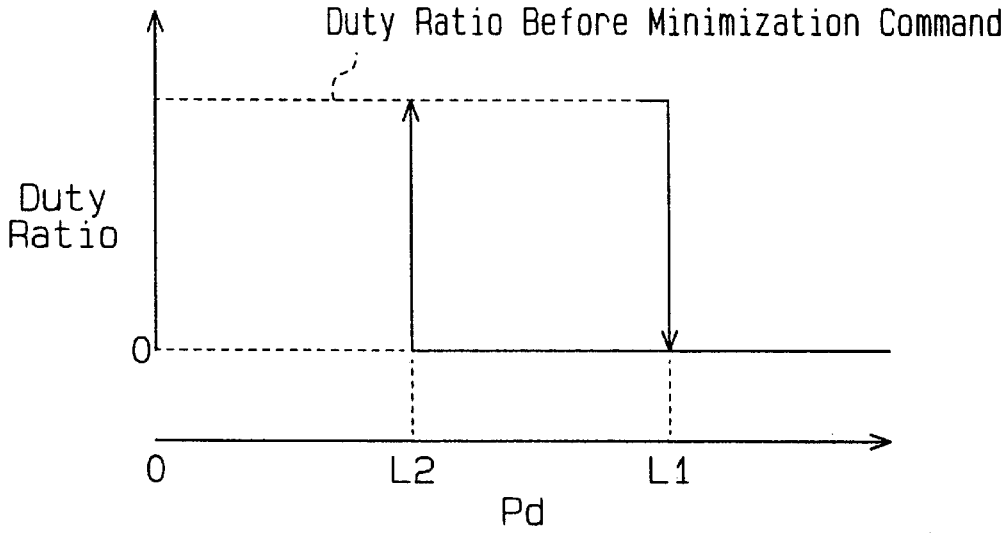
FIG. 4 is a graph showing the operation of the controller of the compressor shown in FIG. 1.

When the discharge pressure Pd detected by the discharge pressure sensor 77 changes from a value that is lower than a first threshold value L1 to a value that is higher than the first threshold value L1, the controller 70 commands the drive circuit 71 to set the duty ratio sent to the coil 67 to 0% as shown in the graph of FIG. 4, regardless of the cooling load, or cooling performance required for the refrigerant circuit. The compressor displacement is therefore decreased quickly and the discharge pressure Pd stops increasing and starts decreasing. Thus, the pipes of the external refrigerant circuit 30 are prevented from receiving excessive load due to a high value of the discharge pressure Pd.

The controller 70 stores the value of the duty ratio immediately before commanding the minimization of the displacement. The stored duty ratio is used as a target value when the displacement returns to a normal value. When the discharge pressure Pd is lowered to and drops below a second threshold value L2, which is lower than the first threshold value L1, the controller 70 commands the drive circuit 71 to send a current the duty ratio of which is equal to the stored duty ratio. Accordingly, the compressor displacement starts being controlled in accordance with the cooling load.

The above embodiment has the following advantages.

(1) The controller 70 immediately minimizes the compressor displacement when the discharge pressure Pd is excessively high. Thus, the shutoff valve 69 stops the circulation of refrigerant through the external refrigerant circuit 30. The compressor operates at the minimum displacement, which is not zero, and an internal refrigerant circuit is formed in the compressor. Therefore, lubricant is not discharged from the compressor and the sliding parts of the pistons 20 and the cylinder bores 1*a* are reliably lubricated by lubricant contained in the circulating refrigerant.

(2) The controller 70 starts the minimization control of the compressor displacement at the first threshold value L1 of the discharge pressure Pd and stops the minimization control at the second threshold value L2 of the discharge pressure Pd. The first threshold value L1 is different from the second threshold value L2. In other words, there is a hysteresis. Therefore, unlike a case in which there is only one threshold value, the minimization control is not started and stopped too frequently in a short period. This stabilizes the displacement control of the compressor.

(3) Suppose the minimum inclination angle of the swash plate 12 is zero degrees and the minimum displacement is zero. In this case, when the inclination angle of the swash plate 12 is zero, the pistons 20 do not reciprocate, that is, refrigerant gas is not compressed. In this case, the crank chamber pressure Pc cannot be set different from the pressure in the compression chambers 29. The swash plate 12 cannot be increased from zero degrees. Thus, a structure for controlling the displacement that is independent from a structure for controlling the crank chamber pressure is required, which complicates the compressor.

However, in the embodiment of FIGS. 1 to 5, the minimum displacement is not zero. Therefore, the displacement can be increased from the minimum displacement by controlling the crank chamber pressure Pc. In other words, the displacement is controlled by the structure for controlling the crank chamber pressure Pc, which simplifies the structure.

(4) The control valve CV includes the solenoid 60, which changes the target suction pressure according to external signals. The bellows 54 uses the target suction pressure for determining the position of the valve body 43. Therefore, compared to a control valve that has no solenoid, that is, a control valve that has a single target suction pressure, the control valve CV enables finer air conditioning.

(5) The control valve CV is a so-called supply control valve, which adjusts the opening degree of the supply passage 28 for controlling the crank chamber pressure Pc. Therefore, when the displacement need be minimized, the control valve CV fully opens the supply passage 28. Thus, the supply passage 28 is used as a part of the inner refrigerant circuit, which simplifies the structure of the compressor.

(6) The drive shaft 6 is directly coupled to the engine E. When the engine E is running, the drive shaft 6 always rotates. Therefore, in the embodiment of FIGS. 1 to 5, the minimum displacement must be significantly small, or close to zero, compared to a compressor that has a clutch. This is because the power loss of the engine E when refrigeration is not executed must be reduced. Therefore, the flow rate of refrigerant that is returned to the compressor from the external refrigerant circuit tends to be too low when the displacement is close to the minimum value. In other words, the present invention is particularly advantageous when applied to a clutchless type compressor.

It should be apparent to those skilled in the art that the present invention may be embodied in many other specific forms without departing from the spirit or scope of the invention. Particularly, it should be understood that the invention may be embodied in the following forms.

In the illustrated embodiments, the control valve CV changes the target suction value. However, the control valve CV may be used for changing a target discharge pressure. In this case, the target value of the discharge pressure Pd is determined by a target pressure changing means, and the control valve CV automatically determines the position of a valve body such that the discharge pressure Pd is maintained at the target value in accordance with the discharge pressure.

Unlike the illustrated embodiments, two pressure monitoring points may be located in the refrigerant circuit. That is, a first pressure monitoring point may be located, for example, in a discharge pressure zone, and a second pressure monitoring point may be located, for example, in a discharge pressure zone the pressure of which is lower than that of the first pressure monitoring point. In this case, a control valve that detects the pressure difference between the pressure monitoring points may be employed. The control valve has a pressure sensing member. The pressure sensing member is displaced based on the pressure difference to move a valve body such that the compressor displacement is changed to cancel the pressure difference. Therefore, the force applied to the pressure sensing member by the target pressure changing means is changed by external control. Accordingly, the target pressure, which is referred to when the position of the valve body is determined by the pressure sensing member, is varied.

The pressure sensing structure may be omitted from the control valve CV so that the control valve CV functions as an electromagnetic valve.

The control valve CV may be used as a so-called bleed control valve, which adjusts the opening degree of the bleed passage 27 for changing the crank chamber pressure Pc. That is, the control valve CV may adjust the opening of any pressure controlling passage that is connected to the crank chamber 5, such as the supply passage 28 and the bleed passage 27.

The minimum inclination angle of the swash plate 12 may be zero degrees so that the minimum displacement of the compressor is zero. In this case, the pistons 20 do not reciprocate when the compressor displacement is minimized, and unnecessary cooling is not performed by rotation of the drive shaft 6. In other words, refrigerant is not discharged to the external refrigerant circuit 30. Also, lubrication need not be maintained between the pistons 20 and the cylinder bores 1*a*. Thus, the shutoff valve 69 may be omitted.

The external information device group 72 may include a rotation speed sensor for detecting the speed of the drive shaft 6, and the controller 70 may change at least the first threshold value L1 in accordance with the speed of the drive shaft 6. That is, if the speed of the drive shaft 6, or the reciprocating speed of each piston 20, is great at the same discharge pressure Pd, lubrication between the pistons 20 and the cylinder bores 1*a* tends to be insufficient. In this case, the controller 70 lowers the first threshold value L1. When the speed of the drive shaft 6 is relatively low, the controller 70 raises the first threshold value L1. Therefore, the air conditioner is reliably protected while the cooling demand is satisfied.

In the illustrated embodiments, the shutoff valve 69 is used to shut the outlet of the compressor. Instead, the shutoff valve 69 may be used for shutting the inlet of the compressor.

The present invention may be embodied in a control valve of a wobble type variable displacement compressor. That is, the present invention may be embodied in any type of variable displacement compressor having a tiltable drive plate that converts rotation of the drive shaft 6 to reciprocation of the pistons 20.

Therefore, the present examples and embodiments are to be considered as illustrative and not restrictive and the invention is not to be limited to the details given herein, but may be modified within the scope and equivalence of the appended claims.

What is claimed is:

1. An apparatus for controlling a variable displacement compressor used in a refrigerant circuit of an air conditioner, wherein the refrigerant circuit includes the compressor and an external circuit, which is connected to the compressor, wherein the compressor compresses refrigerant sent from the external circuit and discharges the compressed refrigerant to the external circuit, wherein the refrigerant circuit has a high pressure zone, which is exposed to the pressure of refrigerant that is compressed by the compressor, wherein the compressor includes a tiltable drive plate and a drive shaft for driving the drive plate, wherein the drive shaft is directly coupled to an external drive source so that the drive shaft is always rotated when the external drive source is running, wherein the drive plate is located in a crank chamber and changes its inclination angle in accordance with the pressure in the crank chamber, and wherein the inclination angle of the drive plate determines the displacement of the compressor, the apparatus comprising:

a control valve, which adjusts the pressure in the crank chamber; and a controller for controlling the control valve, wherein the controller sends a command value that corresponds to cooling performance required for the refrigerant circuit to the control valve, wherein the control valve operates to adjust its opening according to the sent command value, wherein, when the pressure in the high pressure zone is equal to or higher than a predetermined threshold value, the controller sends a command value that can minimize the displacement of the compressor to the control valve thereby limiting the pressure in the high pressure zone.

2. The apparatus according to claim 1, wherein the threshold value is a first threshold value, and wherein the controller continues to send a command value that can minimize the displacement of the compressor to the control valve until the pressure in the high pressure zone is equal to or lower than a second threshold value, which is lower than the first threshold value, after the pressure in the high pressure zone is equal to or higher than the first threshold value.

3. The apparatus according to claim 1, wherein the minimum displacement of the compressor is zero.

4. The apparatus according to claim 1, wherein the minimum displacement of the compressor is greater than zero, wherein the refrigerant circuit includes a circulation stopping mechanism, which stops circulation of refrigerant in the refrigerant circuit when the compressor displacement is minimum, and wherein, when the circulation stopping mechanism stops refrigerant circulation in the refrigerant circuit, refrigerant circulates within the compressor.

5. The apparatus according to claim 4, wherein the circulation stopping mechanism is a shutoff valve, which prevents refrigerant from being discharged to the external circuit from the compressor.

6. The apparatus according to claim 4, wherein the compressor includes:

a piston, which is reciprocated by the drive plate;

a suction chamber for receiving refrigerant from the external circuit;

a cylinder bore for accommodating the piston, wherein a compression chamber is defined in the cylinder bore, and wherein the piston compresses refrigerant that is drawn into the compression chamber from the suction chamber; and a discharge chamber for receiving compressed refrigerant gas from the compression chamber, wherein the discharge chamber forms a part of the high pressure zone, wherein the compressed gas is sent to the external circuit from the discharge chamber, wherein, when the circulation stopping mechanism stops circulation of refrigerant in the refrigerant circuit, an internal refrigerant circuit, which includes the discharge chamber, the crank chamber, the suction chamber, and the compression chamber, is formed in the compressor.

7. The apparatus according to claim 6, wherein the compressor includes a supply passage, which connects the discharge chamber to the crank chamber, and a bleed passage, which connects the crank chamber to the suction chamber, wherein the supply passage and the bleed passage form a part of the internal refrigerant circuit, and wherein the control valve is located in the supply passage to adjust the opening of the supply passage.

8. The apparatus according to claim 1, wherein the control valve includes:

a valve body;

a pressure sensing member, which actuates the valve body according to the pressure at a pressure monitoring point, which is located in the refrigerant circuit, thereby changing the displacement of the compressor such that the pressure at the pressure monitoring point seeks a predetermined target value; and an actuator, which urges the valve body with a force that corresponds to the command value sent from the controller, wherein the urging force of the actuator represents the target value.

9. An apparatus for controlling a variable displacement compressor used in a refrigerant circuit of an air conditioner, wherein the refrigerant circuit includes the compressor and an external circuit, which is connected to the compressor, wherein the compressor compresses refrigerant sent from the external circuit and discharges the compressed refrigerant to the external circuit, wherein the refrigerant circuit has a high pressure zone, which is exposed to the pressure of refrigerant that is compressed by the compressor, wherein the compressor includes a tiltable drive plate, which is located in a crank chamber and changes its inclination angle in accordance with the pressure in the crank chamber, and wherein the inclination angle of the drive plate determines the displacement of the compressor, wherein the minimum displacement of the compressor is greater than zero, wherein the refrigerant circuit includes a shutoff valve, which is actuated according to the pressure in the high pressure zone, wherein the shutoff valve stops circulation of refrigerant in the refrigerant circuit when the compressor displacement is minimum, and wherein, when the shutoff valve stops refrigerant circulation in the refrigerant circuit, refrigerant circulates within the compressor, the apparatus comprising:

a control valve, which adjusts the pressure in the crank chamber; and a controller for controlling the control valve, wherein the controller sends a command value that represents cooling performance required for the refrigerant circuit to the control valve, wherein the control valve operates to adjust its opening according to the sent command value, wherein, when the pressure in the high pressure zone is equal to or higher than a predetermined threshold value, the controller sends a command value that can minimize the displacement of the compressor to the control valve thereby limiting the pressure in the high pressure zone.

10. The apparatus according to claim 9, wherein the threshold value is a first threshold value, and wherein the controller continues to send a command value that can minimize the displacement of the compressor to the control valve until the pressure in the high pressure zone is equal to or lower than a second threshold value, which is lower than the first threshold value, after the pressure in the high pressure zone is equal to or higher than the first threshold value.

11. The apparatus according to claim 9, wherein the compressor includes:

a suction chamber for receiving refrigerant from the external circuit;

a cylinder bore for accommodating the piston, wherein a compression chamber is defined in the cylinder bore, and wherein the piston compresses refrigerant that is drawn into the compression chamber from the suction chamber; and a discharge chamber for receiving compressed refrigerant gas from the compression chamber, wherein the discharge chamber forms a part of the high pressure zone, wherein the compressed gas is sent to the external circuit from the discharge chamber, wherein, when the circulation of refrigerant in the refrigerant circuit is stopped, an internal refrigerant circuit, which includes the discharge chamber, the crank chamber, the suction chamber, and the compression chamber, is formed in the compressor.

12. The apparatus according to claim 11, wherein the compressor includes a supply passage, which connects the discharge chamber to the crank chamber, and a bleed passage, which connects the crank chamber to the suction chamber, wherein the supply passage and the bleed passage form a part of the internal refrigerant circuit, and wherein the control valve is located in the supply passage to adjust the opening of the supply passage.

13. The apparatus according to claim 9, wherein the control valve includes:

a valve body;

a pressure sensing member, which actuates the valve body according to the pressure at a pressure monitoring point, which is located in the refrigerant circuit, thereby changing the displacement of the compressor such that the pressure at the pressure monitoring point seeks a predetermined target value; and an actuator, which urges the valve body with a force that corresponds to the command value sent from the controller, wherein the urging force of the actuator represents the target value.

14. The apparatus according to claim 9, wherein the compressor includes a drive shaft for driving the drive plate, and wherein the drive shaft is directly coupled to an external drive source so that the drive shaft is always rotated when the external drive source is running.

15. A method for controlling a variable displacement compressor used in a refrigerant circuit of an air conditioner, wherein the refrigerant circuit includes the compressor and an external circuit, which is connected to the compressor, wherein the compressor compresses refrigerant sent from the external circuit and discharges the compressed refrigerant to the external circuit, and wherein the refrigerant circuit has a high pressure zone, which is exposed to the pressure of refrigerant that is compressed by the compressor, wherein the compressor includes a tiltable drive plate, which is located in a crank chamber, and a drive shaft for driving the drive plate, wherein the drive shaft is directly coupled to an external drive source so that the drive shaft is always rotated when the external drive source is running, wherein the drive plate changes its inclination angle in accordance with the pressure in the crank chamber, and wherein the inclination angle of the drive plate determines the displacement of the compressor, the method comprising:

adjusting the pressure in the crank chamber by a control valve, wherein the control valve operates according to a command value, which represents cooling performance required for the refrigerant circuit; and sending a command value that can minimize the displacement of the compressor to the control valve thereby limiting the pressure in the high pressure zone when the pressure in the high pressure zone is equal to or higher than a predetermined threshold value.

16. The method according to claim 15, wherein the minimum displacement of the compressor is zero.

17. The method according to claim 15, wherein the minimum displacement of the compressor is greater than zero, the method further including:

stopping circulation of refrigerant in the refrigerant circuit when the compressor displacement is minimized; and circulating refrigerant within the compressor when circulation of refrigerant in the refrigerant circuit is stopped.

* * * * *